United States Patent [19]

Lande

[11] Patent Number: 4,710,982

[45] Date of Patent: Dec. 8, 1987

[54] ZIPPER NECKTIE

[76] Inventor: Martin Lande, 34 Glenmore Road, Hampstead, Quebec, Canada, H3X 3M6

[21] Appl. No.: 801,694

[22] Filed: Nov. 25, 1985

[30] Foreign Application Priority Data

Nov. 1, 1985 [CA] Canada ..... 494395

[51] Int. Cl.[4] ..... A41D 25/02

[52] U.S. Cl. ..... 2/150; 2/153; 2/DIG. 6; 24/388; 24/436

[58] Field of Search ..... 2/DIG. 6, 144, 150, 2/153, 145, 149, 152 R, 152 A, 155; 24/387, 388, 435, 436

[56] References Cited

U.S. PATENT DOCUMENTS

| | | | |
|---|---|---|---|
| 2,247,184 | 6/1941 | Burfening . | |
| 2,378,719 | 6/1945 | Morin | 24/436 X |
| 2,553,437 | 5/1951 | Burke | 2/150 |
| 2,784,473 | 3/1957 | Morin | 24/436 X |
| 3,009,235 | 11/1961 | DeMestral . | |
| 3,127,618 | 4/1964 | Roach . | |
| 3,530,549 | 9/1970 | Manchester, Jr. | 24/436 X |
| 3,737,917 | 6/1973 | Orr | 2/150 |
| 3,898,698 | 8/1975 | Byrd et al. | 2/150 |
| 3,942,192 | 3/1976 | Harris . | |
| 4,513,453 | 4/1985 | Chen et al. | 2/153 X |
| 4,615,048 | 10/1986 | Gasser | 2/153 |
| 4,656,672 | 4/1987 | Lande | 2/153 X |

FOREIGN PATENT DOCUMENTS

| | | |
|---|---|---|
| 816973 | 7/1969 | Canada . |
| 960021 | 12/1974 | Canada . |
| 971702 | 7/1975 | Canada . |
| 987053 | 4/1976 | Canada . |
| 1100295 | 5/1981 | Canada . |
| 1115032 | 12/1981 | Canada . |
| 1178162 | 5/1959 | France . |

*Primary Examiner*—Andrew M. Falik

*Attorney, Agent, or Firm*—Schwartz, Jeffery, Schwaab, Mack, Blumenthal & Evans

[57] ABSTRACT

A necktie has a slide fastener including a slide means, a knot portion having an opening therethrough, and a front tie portion depending from said knot portion. A rear tie portion has a lower end extending through said opening and has an upper neck embracing loop, said neck embracing loop having interlockable means. The slide means is operatively connected to said interlockable means for interlocking and unlocking said interlockable means upon relative movement between said interlockable means and said slide means for varying the size of said neck embracing loop. The interlocking means comprises a loop defined by a single slide fastener stringer having a continuous string of interlocked elements of identical construction.

8 Claims, 8 Drawing Figures

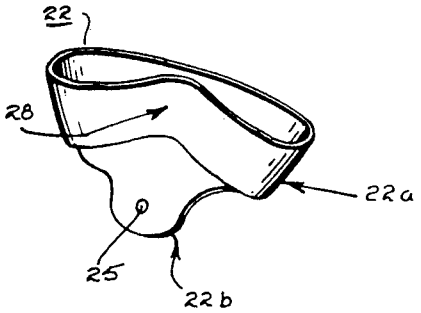
FIG. 7
FIG. 8
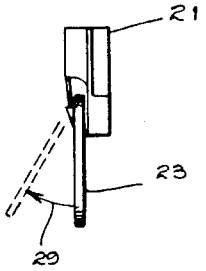
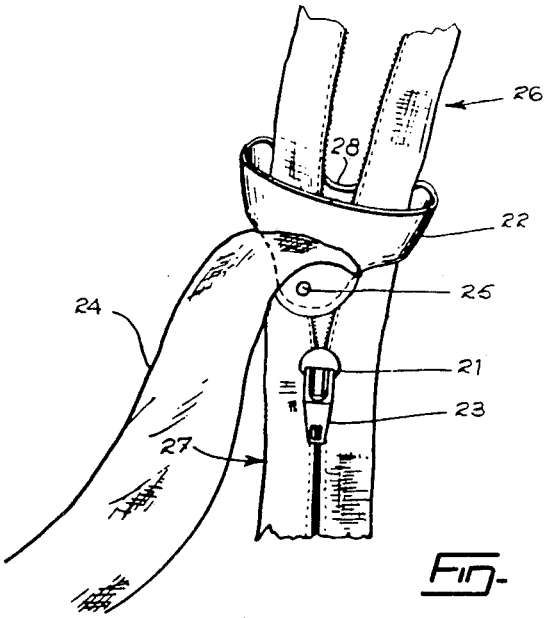
FIG. 6

ZIPPER NECKTIE

BACKGROUND OF THE INVENTION

1. Field of the Invention

The present invention relates to neckties designed with a permanent knot and which are adjustable about the neck by means of a slide fastener loop, i.e. the size of the loop is varied by means of a slide fastener assembly.

2. Related Art

Necktie designs of this type are described for example, in U.S. Pat. Nos. 2,247,184, 3,127,618, 3,737,917, 3,898,698, 3,942,192 and 4,513,453; in Canadian Pat. Nos. 971702 and 987053 and in French Pat. No. 1178162.

Known necktie designs of the above type are constructed so that the size of the neck embracing loop is varied by the means of a zipper which consists of a slide fastener and two separate slide fastener stringers which must be secured together by stitching or other suitable means at the upper ends thereof in order to complete the neck loop. A considerable amount of time and labor is required in order to assemble such ties which of course adds to production costs.

Known neckties of the above type also tend to loosen during use requiring the wearer to readjust the tie about the wearer's neck.

It would be advantageous to have a necktie of the above type wherein the use of two separate slide fastener stringers could be avoided. It would further be advantageous to have a necktie of the above kind wherein the loosening of the tie during use could be inhibited.

It would also be advantageous to have a necktie wherein the loop is provided with means which inhibits the neck loop from being drawn too lightly about the neck while at the same time inhibiting the tie from loosening during use.

OBJECTS AND SUMMARY OF THE INVENTION

The present invention provides in a necktie comprising slide fastener means, a knot portion having an opening therethrough, a front tie portion depending from said knot portion, and a rear tie portion having a lower end extending through said opening and having an upper neck embracing loop, said neck embracing loop having interlockable means, and said slide fastener means being operatively connected to said interlockable means for interlocking and unlocking said interlockable means upon relative movement between said interlockable means and said slide fastener means for varying the size of said neck embracing loop, the improvement wherein said interlocking means comprises a loop defined by a single slide fastener stringer having a continuous string of slide fastener coupling elements of identical construction.

The present invention, in particular provides a necktie comprising slide fastener means, a rigid, knot supporting means having an opening therethrough, a rear tie portion having a lower end extending through said opening and having an upper neck embracing loop and a front tie portion having an upper end thereof fixed to said rigid knot supporting means and wrapped around said knot supporting means to form a knot portion, said neck embracing loop having interlockable means, said slide fastener means being fixed to said rigid knot supporting means within said opening and operatively connected to said interlockable means for interlocking and unlocking said interlockable means upon relative movement between said interlockable means and said slide fastener means for varying the size of said neck embracing loop, and said interlocking means comprising a loop defined by a single slide fastener stringer having a continuous string of slide fastener coupling elements of identical constructon.

In accordance with the present invention the necktie may additionally include means for releasably inhibiting relative movement between said interlockable means and said slide fastener means.

In particular in accordance with the present invention the necktie may additionally include separable fastening means for inhibiting relative movement between said interlockable means and said slide fastener means when said separable fastener means is in the operative position. The separable fastener means may comprise first and second members, the first member being secured to the lower end of the rear side of the front tie portion, the second member being secured to the front side of the lower end of the rear tie portion. Each of said members can have a base sheet material which is respectively secured to the front tie portion and the rear tie portion and may be provided with a large number of closely spaced interengageable hooking elements extending from a respective base material in the form of a pile whereby when the members are urged toward one another in face to face relation to place said separable fastening means in the operative position the interengageable hooking elements separably interlock to secure said members in said face to face relation.

In accordance with the present invention the opening in the rigid knot supporting means may be defined by a hollow upper portion the front of which tapers downwardly to a tongue. The necktie may also additionally include separable fastening means for inhibiting relative movement between said interlockable means and said slide fastener means when said separable fastener means is in the operative position. In this case, as in the above embodiment, the separable fastener means may comprise first and second members. However for this embodiment the first member is secured to the back side of the tongue while the second member is secured to the front side of the loop of the rear tie portion. Each of said members may have a base sheet material which is respectively secured to said tongue or the front side of the loop of the rear tie portion and may be provided with a large number of closely spaced interengageable hooking elements extending from a respective base material in the form of a pile whereby when the members are urged toward one another in face to face relation to place the separable fastening means in the operative position the interengageable hooking elements separably interlock to secure said members in said face to face relation.

In accordance with the present invention the knot portion may additionally include a stopper for inhibiting relative movement between said interlockable means and said slide fastener means, said stopper being disposed within the opening of the rigid knot supporting means, said stopper slidingly engaging said interlockable means and said stopper being made of a compressable foam material, for example a synthetic foam material such as polyurethane foam.

The present invention also provides a necktie comprising a rigid knot supporting means having an opening therethrough, a rear tie portion having a lower end extending through said opening and having an upper neck embracing loop, slide fastener means, a gripping tab pivotably attached to the slide fastener means, and a front tie portion having an upper end thereof fixed to said rigid knot supporting means and wrapped around said rigid knot supporting means to form a knot portion, said neck embracing loop having interlockable means, said slide fastener means being operatively connected below said rigid knot supporting means to said interlockable means for interlocking and unlocking said interlockable means upon relative movement between said interlockable means and said slide fastener means for varying the size of said neck embracing loop, said slide fastener means including locking means for inhibiting the unlocking of said interlockable means, said gripping tab cooperating with said locking means so that when the gripping tab is in a first pivot position the locking means is operative and in a second pivot position the locking means is inoperative, the opening through the rigid knot support means being sized so that the slide fastener means cannot pass therethrough and said interlocking means comprising a loop defined by a single slide fastener stringer having a continuous string of slide fastener coupling elements of identical construction.

A necktie in accordance with the present invention (i.e. made with the single stringer,) can provide assembly cost savings of up to 45% in relation to a necktie made using two separate stringers for the neck loop.

As indicated above, in accordance with the present invention, the interlocking means comprises a loop defined by a single slide fastener stringer. A useful slide fastener stringer can be obtained from Y K K Canada Inc., under the designation 25 CF Ziplon. Other slide fastener stringers which may be useful in the context of the present invention are described in Canadian Pat. Nos. 816973, 960021 and 1100295. Canadian Pat. No. 1115032, for example, shows a slide loop fastener (see FIG. 6 thereof).

Canadian Pat. No. 960021, for example, describes a stringer provided with fastener elements in the form of a continuous helical coil. Each coil consists of a coupling head, two arms extending from opposite ends of said head in a direction in which they depart sidewise from each other. Turns extend from the arms and connect between adjacent coils. The turns in adjacent coils are spaced apart from each other, and a stiffening cord is inserted through the row of fastener elements, leaving a clearance close at said coupling heads. Each of the coils assumes a shape analogous to the small letter "l" when projected to the plane of the fastener and the fastener elements are sewn together with the cord closely along said clearance.

In accordance with the present invention suitable separable fastening means can be made of a product designated as Velcro (a Trademark) obtained from Velcro Canada Ltd. A separable fastening means is for example described in U.S. Pat. No. 3,009,235. The separable fastening means of a necktie in accordance with the present invention (e.g. Velcro) can be easily unlocked. The separable fastening means can be used to advantage over known locking means since jamming problems can be avoided, i.e. it is possible to avoid jamming the loop in a chocking position.

Self-locking slide fastener mechanisms can be used as an alternate means for releasably unhibiting relative movement between the interlockable means and the slide fastener means. Such mechanisms are known and can, for example, be obtained from Y K K Canada Inc. Known mechanisms include a slide fastener means, a locking means and a gripping tab. The gripping tab is pivotally connected to the slide fastener means and the locking means is built into the slide fastener means. The gripping means and the locking means are adapted to cooperate so that when the tab is more or less parallel to the plane of the interlockable means in the immediate vicinity of the slide fastener means (i.e. in the first pivot position) the locking means is operative, i.e. it inhibits the unlocking of the interlockable means by the slide fastener. In order to release the slide fastener means the gripping tab is pivoted so that it is at an angle to the plane of the interlockable means in the immediate vicinity of the slide fastener means (i.e. in a second pivot position). Usually, the action of gripping the tab with the fingers will be sufficient to displace the tab to a second pivot position wherein the slide fastener is free i.e. to properly grip the tab, the tab must be displaced to a second pivot position from its at rest (i.e. first) position.

BRIEF DESCRIPTION OF THE DRAWINGS

The invention is more particularly described below in relation to embodiments of the invention wherein the necktie is constructed by making use of a particular rigid knot support; other knot constructions could of course be used.

In drawings which illustrate embodiments of the invention,

FIG. 6 is a partial perspective view of an alternate embodiment of the present invention viewed from the front before the front tie portion is wrapped around the rigid knot support means to form a knot portion, FIG. 7 is a perspective view from the back side of the rigid knot supporting means used in the embodiment shown in FIG. 6, and FIG. 8 is a side view of a self locking slide fastener mechanism used in the embodiment shown in FIG. 6.

DETAILED DESCRIPTION OF THE INVENTION

Figure 1:
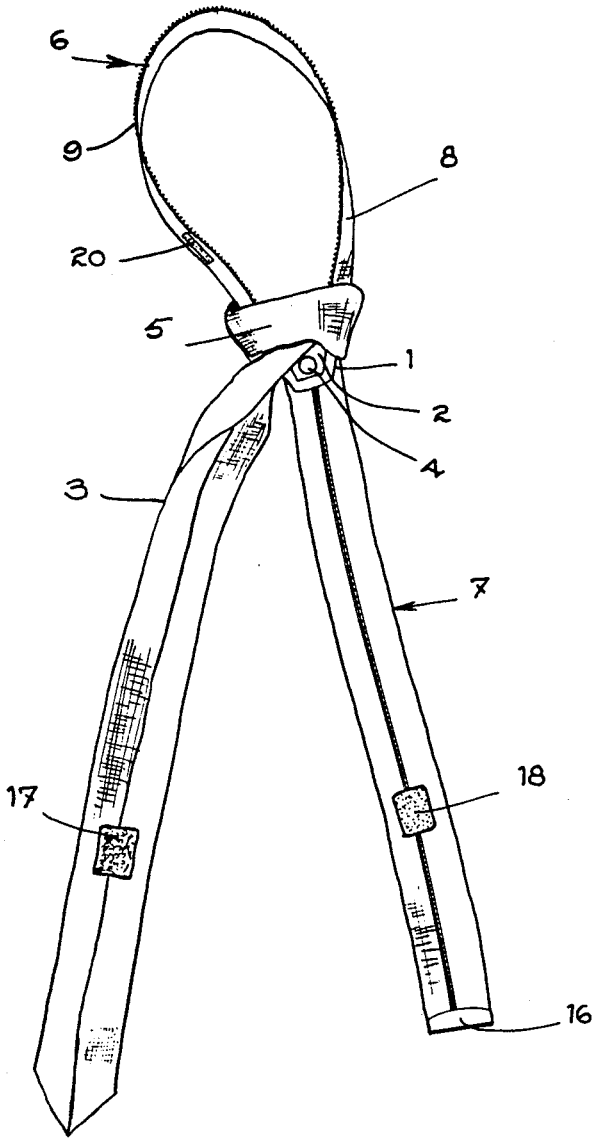
FIG. 1 is a perspective view of an embodiment viewed from the front.

Referring to FIG. 1 the necktie of the embodiment shown has a rigid knot support means 1. The upper end 2 of the front tie portion 3 is fixed to the rigid knot support means 1 by a rivet 4. The front tie portion 3 as discussed below is wrapped around the rigid knot support means 1 to form a knot portion 5. The rear portion of the necktie has a neck embracing loop designated generally as 6. The lower end of the rear portion of the necktie designated generally as 7 extends through an opening in the rigid knot support means 1.

Figure 2:
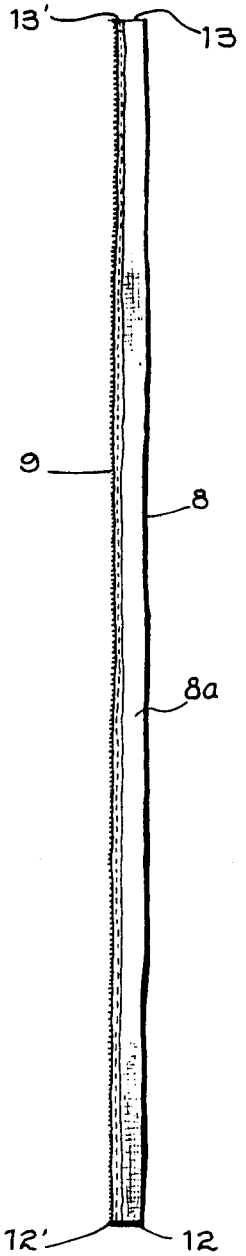
FIG. 2 illustrates a single slide fastener stringer prior to incorporation in the necktie illustrated in FIG. 1.

The rear portion of the necktie may be made from a single slide fastener stringer 8 (see FIG. 2) designated as 25 CF Ziplon obtained from Y K K Canada Inc. The stringer 8 is provided along an edge thereof with a continuous string 9 of slide fastener coupling elements of identical construction. A border 8*a* of similar material as the front tie portion or element 3 is sewn along the side of the stringer 8.

Figure 3:
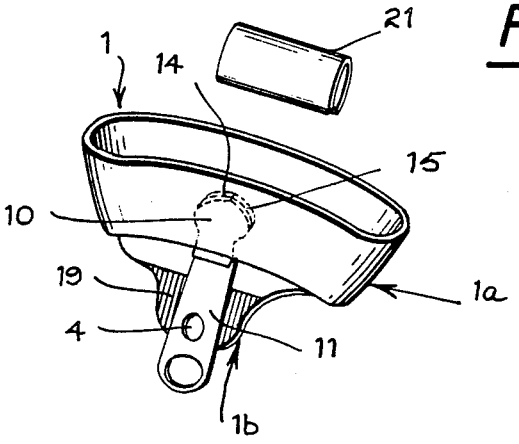
FIG. 3 is a perspective view from the back side of the rigid knot supporting means used for the embodiment illustrated in FIG. 1.

The front and rear tie portions are not shown in FIG. 3 which illustrates the rigid knot support means 1. The rigid support means 1 has a hollow upper portion 1*a*, the front of which tapers downwardly to a tongue portion 1*b*. A slide fastener 10 is secured within the opening in the rigid knot support means 1 dividing the opening into two portions. The slide fastener 10 is attached to a gripping tab or slider arm 11 which is fixed to the tongue portion 1*b* by the same rivet 4 that secures the end 2 of the front tie portion 3 to the front of the support means 1.

In order to provide the rear tie portion having the neck embracing loop 6 the ends 12 and 13 of the stringer 8 (see FIG. 2) are manipulated so that the ends 12' and 13', of the string 9 are pushed through respective openings 14 and 15 in the slide fastener 10 to interlock opposing coupling elements of the single slide fastener stringer. In this way not only is the loop 6 formed but also the lower end 7. The ends 12 and 13 of the stringer 8 are clamped together by clamping means 16 (see FIG. 1) once the rear tie portion is in place.

Figure 4:
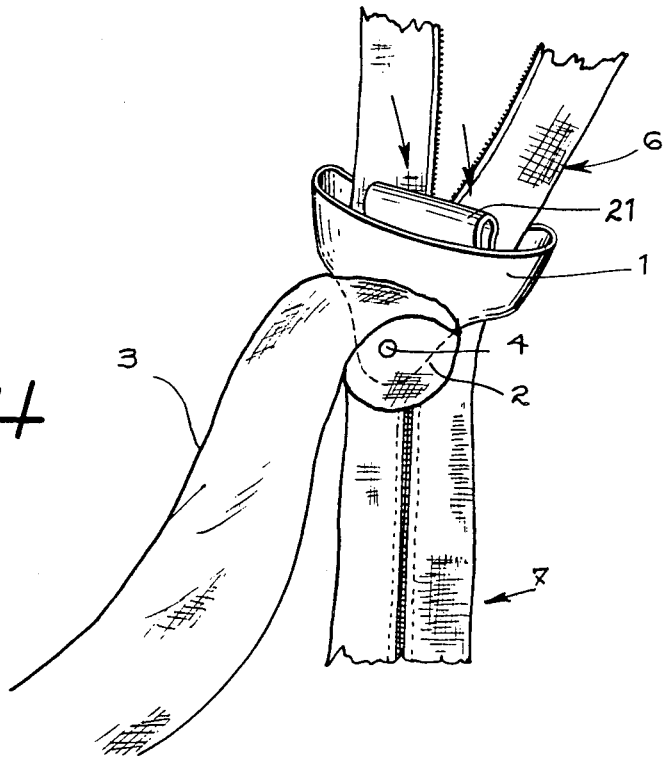
FIG. 4 is a partial perspective view of the embodiment illustrated in FIG. 1 viewed from the front before the front tie portion is wrapped around the rigid knot support means to form a knot portion.
Figure 5:
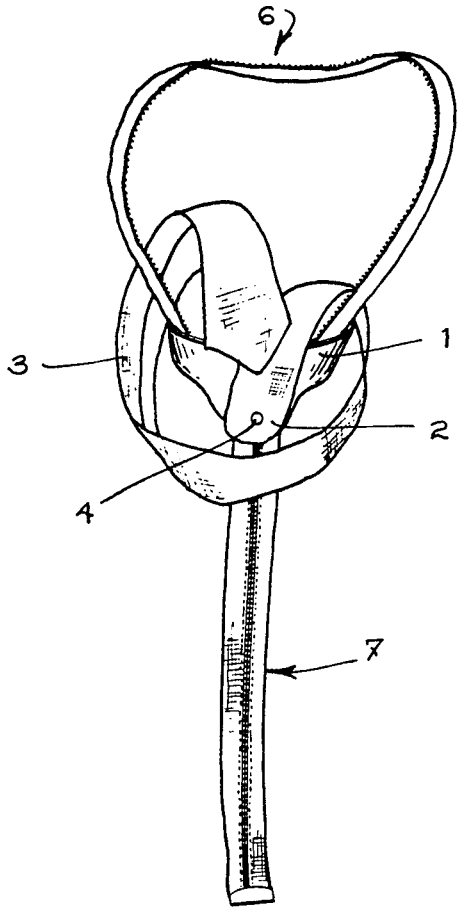
FIG. 5 is a front view of the embodiment in FIG. 1 illustrating the wrapping of the front tie portion about the rigid knot support means to form a knot portion.

Referring to FIGS. 4 and 5, FIG. 4 shows the front tie portion fixed to the rigid knot support means 1 at its upper end 2 by rivet 4 prior to being wrapped around the support means 1 to form the knot portion. FIG. 5 shows the front tie portion 3 in the process of being wrapped or looped around the support means 1. Once the wrapping operation is complete the knot portion 5 is as in FIG. 1.

In order to wear the necktie described above, if the loop is not sufficiently large to pass over the head the knot portion 5 is gripped with one hand and the loop 6 pulled with the other hand. The loop 6 is then passed over the head and positioned. The necktie is snuggled around the neck by gripping the knot portion 5 with one hand and pulling the lower end 7 down with the other hand to cause the knot poton 5 to move upwardly under the wearer's neck. The operation is reversed to remove the necktie.

The necktie may be provided with separable fastening means for releasably inhibiting relative movement between the coupling elements of the stringer 8 and the slide fastener 10. The separable fastening means may consist of first and second pads each made of Velcro.

For example, referring to FIG. 1 the separable fastening means may consist of pads 17 and 18. The first pad 17 is attached to the back side of the lower end of the front tie portion 3. The second pad 18 is attached to the front side of the lower end 7 of the rear tie portion. The Velcro pads 17 and 18 are so disposed that once the tie is in the desired position about the neck the pads can be pressed together to releasably fix one to the other. The pads are separated prior to removing the necktie.

Alternatively the tie may be provided with separable fastening means which not only inhibits the loop from loosening during use but also acts as a stopper which inhibits the size of the loop from being reduced beyond a predetermined size. For example referring to FIGS. 1 and 3 such alternate fastening means may comprise a pad 19 and a strip 20 both made of Velcro. As can be seen in FIG. 3 which is a back view of the rigid knot support means 1, pad 19 is secured to the back side of tongue 1*b*. Referring to FIG. 1 strip 20 is attached to the front side of the loop 6 i.e. to the side of the stringer 8 which eventually forms part of the front side of the lower end 7 of the rear tie position. As the lower end 7 is elongated by pulling it downwardly so that the loop gets progressively smaller the strip 20 will eventually pass through the hollow upper portion 1a of the rigid knot supporting means and thereafter be urged into contact with pad 19. Once strip 20 and pad 19 have come into contact they will tend to interlock with each other thus inhibiting the loop size from being reduced further. The length of the strip 20 and its position on the loop is set to take into account the desired size of neck for which the tie is destined.

As an alternative to strip 20 and pad 19 the necktie may be provided with a stopper comprising a piece of suitable foam material such as polyurethane foam, the stopper being used to inhibit relative movement between the interlockable means and said separable fastening means. In accordance with this alternative the stopper 21 may comprise a piece of urethane foam (see FIG. 3) which is placed about slide fastener 10. Once the necktie is assembled with the front tie portion 3 wrapped around the rigid knot supporting means 1, the stopper 21, will slidingly engage the stringer 8 so as to inhibit relative movement thereof. Suitable foam can be obtained from Vita-foam under the designation Extra-prime, polyurethane (density 3 lb/ft$^3$ or 48 kilo/m$^3$ having a support factor 2.1 modulus).

FIGS. 6, 7 and 8 show an alternate version of a tie in accordance with the present invention which is provided with means to releasably inhibit relative movement between the interlocker means and the slide fastener means i.e. inhibit unlocking. In accordance with this version the slide fastener itself is adapted to inhibit such movement.

Referring to FIG. 6, the slide fastener 21 is not fixed to the rigid knot support means 22 by gripping tab 23. On the contrary the slide fastener 21 is free to move not only relative to the interlockable means but also relative to the rigid knot support means 22. The front tie portion 24, as in the case of the tie shown in FIG. 1, is however fixed to the rigid knot support means 22 by a rivet 25. The rear tie portion of the necktie shown has a neck embracing loop designated generally as 26. The lower end of the rear portion of the necktie designated generally as 27 extends through the opening in the rigid knot support means 22. The rear tie portion is as in the case of the tie shown in FIG. 1 made from a single slide fastener stringer.

The front and rear tie portions are not shown in FIG. 7 which illustrates the rigid knot support means 22. The rigid support means 22 has a hollow upper portion 22*a*, the front of which tapers downwardly to a tongue portion 22*b*. A back portion 28 of the upper portion 22*a* is pinched inwardly to such an extent that the opening is sized so that opposing portions of the string may pass through the opening on either side of the pinch in the rigid knot support means 22 but is not large enough to allow the slide fastener 21 to pass therethrough. Any other mechanism which will suitably size the opening can of course be used.

Referring back to FIG. 6 the slide fastener 21 is located below the rigid knot support means 22, i.e. it is disposed on the lower end side of the rear tie portion. Since the opening through the rigid knot support means 22 is pinched off by back portion 28 with respect to the slide fastener 21, the slide fastener 21 cannot be urged through the opening in the rigid knot support means 22 if, for example, the rigid knot support means is gripped with one hand and the loop pulled with the other.

The slide fastener 21 shown is constructed with a known internal locking means. Refering to FIG. 8 the gripping tab 23 can pivot from a first pivot position in the direction of the arrow 29 to a second pivot position shown as a dashed line. The gripping tab 23 cooperates with the locking means (not shown) so that when the gripping tab 23 is in the first pivot position the locking means is operative and inhibits relative movement of the slide fastener with respect to the interengageable means i.e. inhibits unlocking. On the other hand when the gripping tab 23 is in the second pivot position the locking means is inoperative and the slide fastener can be easily displaced relative to the interengageable means. As indicated above these types of slide fastener mechanisms are known.

The knot portion is formed in the same manner for this tie as shown in FIG. 5.

In order to wear the necktie shown in FIGS. 6, 7 and 8, if the loop is set sufficiently large to pass over the head the gripping tab 23 is grasped with one hand and the loop 26 pulled with the other. The gripping tab 23 is of course grasped so that it is in the second pivot position. The loops 26 is then passed over the head and positioned. The necktie is snuggled around the neck by gripping the lower end 27 with one hand and pulling the slide fastener 21 upward by grasping the gripping tab 23 with the other hand. The slide fastener 21 is advanced upwardly until it abuts the rigid knot support means previously disposed adjacent to the neck, causing loop 26 to close around the neck to the desired size. The operation is reversed to remove the necktie.

The embodiments of the invention in which an exclusive property or privilege is claimed are defined as follows:

1. In a necktie comprising: a slide fastener including a slide means, a knot portion having an opening therethrough, a front tie element depending from said knot portion, and a rear tie element having a lower end portion extending through said opening and having an upper neck embracing loop portion, said rear tie element comprising only one slide fastener stringer and a border of similar material as the front tie element sewn along a longitudinal edge portion of said stringer, said slide fastener stringer comprising a continuous string of interlockable elements of identical construction, said slide means being operatively connected to said interlockable elements for interlocking and unlocking said interlockable elements upon relative movement between said rear tie element and said slide means for varying the size of said neck embracing loop portion, said lower end portion of said rear tie element including interlocked portions of said rear tie element so that said border extends at least partially along opposite sides of said lower end portion.

2. A necktie as defined in claim 1 additionally including means for releasably inhibiting relative movement between said interlockable means and said slide means.

3. A necktie comprising a slide fastener including slide means, a rigid, knot supporting means having an opening therethrough, a rear tie element having a lower end portion extending through said opening and having an upper neck embracing loop portion, and a front tie element having an upper end portion thereof fixed to said rigid knot supporting means and wrapped around said knot supporting means to form a knot portion, said rear tie element comprising only one slide fastener stringer and a border of similar material as the front tie element sewn along a longitudinal edge portion of said stringer, said stringer comprising a continuous string of interlockable elements of identical construction, said slide means being fixed to said rigid knot supporting means within said opening and operatively connected to said interlockable elements for interlocking and unlocking said interlockable elements upon relative movement between said rear tie element and said slide means for varying the size of said neck embracing loop portion, said lower end portion of said rear tie element including interlocked portions of said rear tie element so that said border extends at least partially along opposite sides of said lower end portion.

4. A necktie as defined in claim 2 additionally including separable fastening means for inhibiting relative movement between said interlockable means and said slide means when said separable fastener means is in the operative position, said separable fastener means comprising first and second members, the first member being secured to the lower end portion of the rear side of the front tie element, the second member being secured to the front side of the lower end portion of the rear tie element, each of said members having a base sheet material which is respectively secured to the front tie element or the rear tie element and being provided with a large number of closely spaced interengageable hooking elements extending from a respective base material in the form of a pile whereby when said members are urged toward one another in face to face relation to place said separable fastening means in the operative position said interengageable hooking elements separably interlock to secure said members in said face to face relation.

5. A necktie as defined in claim 3 wherein the knot portion additionally includes a stopper for inhibiting relative movement between said interlockable means and said slide fastened means said stopper being disposed within the opening of the rigid knot supporting means, said stopper slidingly engaging said interlockable means and said stopper being made of a compessable foam material.

6. A necktie as defined in claim 5 wherein the foam material is a polyurethane foam.

7. A necktie comprising: a slide fastener including a slide means, a rigid, knot supporting means having an opening therethrough, a rear tie portion having a lower end extending through said opening and having an upper neck embracing loop and a front tie portion having an upper end thereof fixed to said rigid knot supporting means and wrapped around said knot supporting means to form a knot portion, said neck embracing loop having interlockable means, said slide means beaing fixed to said rigid knot supporting means within said opening and operatively connected to said interlockable means for interlocking and unlocking said interlockable means upon relative movement between said interlockable means and said slide means for varying the size of said neck embracing loop, and said interlocking means comprising a single slide fastener stringer having a continuous string of interlockable means of identical construction;

the opening in the rigid knot supporting means being defined by a hollow upper portion the front of which tapers downwardly to a tongue and additionally including separable fastening means for inhibiting relative movement between said interlockable means and said slide fastener means when said separable fastener means is in the operative position, said separable fastener means comprising first and second members, the first member being secured to the back side of said tongue, the second member being secured to the front side of the loop of the rear tie portion, each of said members having a base sheet material which is respectively secured to said tongue or the front side of the loop of the rear tie portion and being provided with a large number of closely spaced interengageable hooking elements extending from a respective base material in the form of a pile whereby when said members are urged toward one another in face to face relation to place said separable fastening means in the operative position said interengageable hooking elements separably interlock to secure said members in said face to face relation.

8. A necktie comprising a rigid, knot supporting means having an opening therethrough, a rear tie portion having a lower end extending through said opening and having an upper neck embracing loop, a slide fastener including a slide means, a gripping tab pivotably attached to the slide means, and a front tie portion having an upper end thereof fixed to said rigid knot supporting means and wrapped around said rigid knot supporting means to form a knot portion, said neck embracing loop having interlockable means, said slide means being operatively connected below said rigid knot supporting means to said interlockable means for interlocking and unlocking said interlockable means upon relative movement between said interlockable means and said slide means for varying the size of said neck embracing loop, said slide means including locking means for inhibiting the unlocking of said interlockable means, said gripping tab cooperating with said locking means so that when the gripping tab is in a first pivot position the locking means is operative and in a second pivot position the locking means is inoperative, the opening through the rigid knot support means being sized so that the slide means cannot pass therethrough and said interlocking means comprising a single slide fastener stringer having a continuous string of interlockable means of identical construction.

* * * * *